US007905546B2

(12) United States Patent
Conner

(10) Patent No.: US 7,905,546 B2
(45) **Date of Patent: *Mar. 15, 2011**

(54) FOLDABLE BLEACHER SEATS

(75) Inventor: Larry R. Conner, Altamont, IL (US)

(73) Assignee: Irwin Seating Company, Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/851,885

(22) Filed: Sep. 7, 2007

(65) Prior Publication Data

US 2007/0296253 A1 Dec. 27, 2007

Related U.S. Application Data

(63) Continuation of application No. 11/070,658, filed on Mar. 2, 2005, now Pat. No. 7,267,403.

(60) Provisional application No. 60/552,233, filed on Mar. 11, 2004.

(51) Int. Cl.
*A47C 7/62* (2006.01)

(52) U.S. Cl. ..... 297/217.7; 297/248; 297/232; 52/8

(58) Field of Classification Search ..... 297/378.1, 297/248, 232, 217.7; 52/8, 10
See application file for complete search history.

(56) References Cited

U.S. PATENT DOCUMENTS 1,668,213 A * 5/1928 Landine ..... 297/39
2,171,374 A 8/1939 Ryan et al.
2,987,111 A * 6/1961 Walworth ..... 52/9
3,025,106 A * 3/1962 Evans et al. ..... 52/9
3,316,014 A * 4/1967 Barecki ..... 297/35
3,584,916 A 6/1971 Bayes
3,994,529 A 11/1976 Lippert
4,063,392 A 12/1977 Van Ryn et al.
4,155,202 A 5/1979 Hartman
4,285,542 A * 8/1981 Boisvert ..... 297/217.7

(Continued)

FOREIGN PATENT DOCUMENTS

JP 403021775 A 1/1991

OTHER PUBLICATIONS

Irwin Telescopic Seating Company brochure, dated 2003, 20 pages.

(Continued)

*Primary Examiner* — David Dunn
*Assistant Examiner* — Erika Garrett
(74) *Attorney, Agent, or Firm* — Van Dyke, Gardner, Linn & Burkhart, LLP

(57) ABSTRACT

A foldable seat for a bleacher seating arrangement includes a seat or seat structure fixedly disposed at a deck portion and a back portion or backrest pivotally disposed at a rear portion of the seat portion. The back portion is pivotable between an upright position, where a person may sit at the seat structure and may lean back against the back portion, and a folded down position, where the back portion may lay generally on top of or at least partially over the seat structure. The back portion may be pivotally mounted to a mounting frame or element fixedly secured relative to the deck portion and may be substantially freely pivotable between the upright and folded down positions. The bleacher seating arrangement may include a plurality of deck portions that may be retracted to a nested position when the backrests or back portions are in their folded down position.

26 Claims, 4 Drawing Sheets

U.S. PATENT DOCUMENTS

| | | | | | |
|---|---|---|---|---|---|
| 4,294,048 | A | | 10/1981 | Sutter | |
| 4,790,594 | A | * | 12/1988 | Temos | 297/248 |
| 4,850,159 | A | * | 7/1989 | Conner | 52/9 |
| 4,871,209 | A | | 10/1989 | Handelman | |
| 4,989,915 | A | | 2/1991 | Hansal | |
| 5,067,771 | A | | 11/1991 | Ellis | |
| 5,069,503 | A | | 12/1991 | Martinez | |
| D348,216 | S | | 6/1994 | Smith | |
| 5,337,471 | A | | 8/1994 | Graney | |
| 5,570,931 | A | | 11/1996 | Kargilis et al. | |
| 5,580,130 | A | | 12/1996 | Williams et al. | |
| 5,653,502 | A | | 8/1997 | Kimura et al. | |
| 5,685,608 | A | | 11/1997 | Yamazaki | |
| 5,829,201 | A | * | 11/1998 | Schelter et al. | 52/9 |
| 5,921,031 | A | | 7/1999 | Williams | |
| 6,029,406 | A | | 2/2000 | Staehlin | |
| 6,055,780 | A | | 5/2000 | Yamazaki | |
| 6,089,669 | A | * | 7/2000 | Wilcox et al. | 297/452.65 |
| 6,113,191 | A | | 9/2000 | Seibold | |
| 6,185,875 | B1 | | 2/2001 | Victor et al. | |
| 6,244,657 | B1 | * | 6/2001 | Momose | 297/217.7 |
| 6,375,255 | B1 | * | 4/2002 | Maruta et al. | 297/15 |
| 6,428,097 | B1 | | 8/2002 | Amemiya et al. | |
| 6,502,902 | B1 | | 1/2003 | Romero | |
| 6,739,669 | B2 | | 5/2004 | Etzioni et al. | |
| 6,945,190 | B1 | | 9/2005 | Frandsen | |
| 7,267,403 | B2 | * | 9/2007 | Conner | 297/217.7 |
| 2007/0200409 | A1 | | 8/2007 | Ahrens et al. | |

OTHER PUBLICATIONS

Hussey Maxam brochure, dated 2002, 18 pages.

Interkal Telescopic Seating Systems brochure, believed to have been published more than one year prior to the filing date of the present application.

* cited by examiner

FOLDABLE BLEACHER SEATS

CROSS REFERENCE TO RELATED APPLICATIONS

The present application is a continuation of U.S. patent application Ser. No. 11/070,658, filed Mar. 2, 2005, now U.S. Pat. No. 7,267,403, which claims the benefit of U.S. provisional application, Ser. No. 60/552,233, filed Mar. 11, 2004, which are hereby incorporated herein by reference in their entireties.

FIELD OF THE INVENTION

The present invention relates generally to bleachers and, more particularly, to telescopic or extendable and retractable bleachers where the decks or benches of the bleachers extend and retract relative to one another for use and storage of the bleachers.

BACKGROUND OF THE INVENTION

Bleacher seats typically include a plurality of benches or decks for people to sit on at a stadium or arena or gymnasium or the like. The bleachers may be extendable and retractable between a retracted or storage position and an extended or in use position. Often, the decks of the bleacher may have a raised seat or bench positioned therealong for seating people at the bleachers.

It is known to provide a back rest along such raised seats or benches. However, the back rests fold down rearwardly and onto the deck behind the raised benches. Such an arrangement requires manual lowering of the back rests before the bleachers can be retracted, and requires manual raising of the back rests when the bleachers are extended before a person can even walk along the deck to reach a desired seat. Also, such an arrangement requires particular minimum spacing between the deck rows, in order to provide sufficient clearance between the seats and the rearward deck for the back rests to rest when in their lowered position.

It is also known to provide foldable portable chairs for a person to carry to a stadium or arena or gymnasium or the like and to temporarily attach the foldable chair to the deck of the bleacher or the like. Such chairs are attachable to the fixed decks of bleachers, such as the aluminum or wooden decks or benches of outdoor bleachers and the like. The foldable and portable stadium chairs may be purchased by a person that attends an event at a stadium or the like and may be hand carried into the stadium and temporarily attached to the bleacher and then removed by the person when they leave the stadium or the like. Although such chairs may provide a more comfortable seating arrangement for the person, the chairs have to be manually carried to and from the stadium and may be cumbersome to transport and to attach to the bleacher bench.

SUMMARY OF THE INVENTION

The present invention provides a foldable seat back or backrest for a bleacher bench or seat and thus provides a seating area for a person to sit at with a backrest to support the back of the person sitting at the bench or seat. The backrest may be folded down when the seat is not in use, such that the bleachers may be retracted to a storage position, where the decks and the bench or seats mounted thereon are arranged in a nested manner. When the bleacher is to be used, the decks may be extended outward and the seat back may be raised from the particular seat to be used and the person may sit at the seat to watch the event at which the bleachers are positioned.

According to an aspect of the present invention, a foldable chair or seat for a bleacher seating arrangement includes a mounting frame, a seat portion and a back portion. The mounting frame is configured to fixedly attach to a deck portion of a bleacher. The seat portion comprises a plastic material and is fixedly secured to the mounting frame. The back portion is pivotally mounted to the mounting frame and is pivotable between an upright position and a folded down position. The back portion has a plastic seat back. The plastic seat back and the seat portion define a seating area when the back portion is in the upright position.

The back portion may be pivotally mounted to the mounting frame via a first hinge member that extends downward from the seat back and pivotally attaches to a second hinge member of the mounting frame. The second hinge member may extend generally rearwardly from the seat portion. The hinge members may cooperate to allow pivotal movement of the seat back between the generally vertical or upright position and the generally horizontal or folded down position, where the seat back is positioned generally on top of the seat portion. The back portion may be freely pivotable between the upright position and the folded down position. The foldable chair or seat may include a front panel that is also fixedly secured to the mounting frame and that extends generally downwardly along the mounting frame below the seat portion.

According to another aspect of the present invention, a bleacher seating arrangement for seating a plurality of people along at least one row of seats includes at least one deck portion, a mounting frame fixedly secured to the deck portion, at least one seat portion attached to the mounting frame, and a plurality of back portions pivotally mounted to the mounting frame and/or the seat portion or portions. The at least one deck portion is generally horizontally oriented and the mounting frame is positioned along a forward portion of the deck portion. The seat portion has at least one plastic seat and is configured to seat a plurality of people along the deck portion. The back portions are individually foldable between an upright position, where a person may sit at the plastic seat at the respective back portion, and a folded down portion where the back portion is folded down onto at least a portion of the plastic seat at which the back portion is positioned.

The seat portion may comprise an elongated seat portion or bench extending at least substantially along the deck portion, whereby the elongated seat portion defines a plurality of seats and wherein the plurality of back portions are positioned along the elongated seat portion. Optionally, the at least one seat portion may comprise a plurality of individual seat portions positioned along the deck portion. Each of the back portions may be pivotally mounted at a corresponding one of the seat portions.

The at least one deck portion may comprise a plurality of deck portions. The deck portions may be movable relative to one another between a nested position, where the deck portions are arranged generally on top of one another, and an extended position, where a lower deck portion is extended outward from an upper deck portion so that the deck portions are arranged in a stepped manner. The back portions may be folded to the folded down position when the deck portions are moved to the nested position.

Therefore, the present invention provides a foldable seat for a bleacher seating arrangement. The mounting frame and seat portion may be fixedly secured to the deck of the bleacher, and the seat back may be pivotally mounted to the frame or seat portion to allow the seat back to be pivoted between the upright and folded down positions. Because the seats and back portions comprise plastic material, they may be suitable for either indoor or outdoor applications. The seat backs may be folded to the folded down position, where the seat back may be positioned generally on top of the seat portion, to allow the bleachers to be retracted to a nested or storage orientation. The seat backs may be freely pivotable so that they may fall or move to their folded down position as the bleacher is retracted. The bleachers may be extended to an in use orientation and the seat backs may be raised upward to the in use or upright position to allow a person to sit at the seat. Because the seat backs rest generally over the seats, the deck is clear so that a person may readily walk along the deck to a desired seat, and then raise the seat back of that respective seat. The present invention thus provides a seat for a bleacher type seating arrangement with a seat back to enhance the comfort of the seat to the people sitting at the bleachers. The seats are fixedly secured to the bleacher decks and arranged next to one another along the deck of the bleachers, such that each person sitting at the bleachers has their own individual backrest. People attending an event or show thus do not have to carry their own portable chair to the event or show in order to have back support while sitting at the event or show.

These and other objects, advantages, purposes and features of the present invention will become apparent upon review of the following specification in conjunction with the drawings.

DESCRIPTION OF THE PREFERRED EMBODIMENTS

Figure 1:
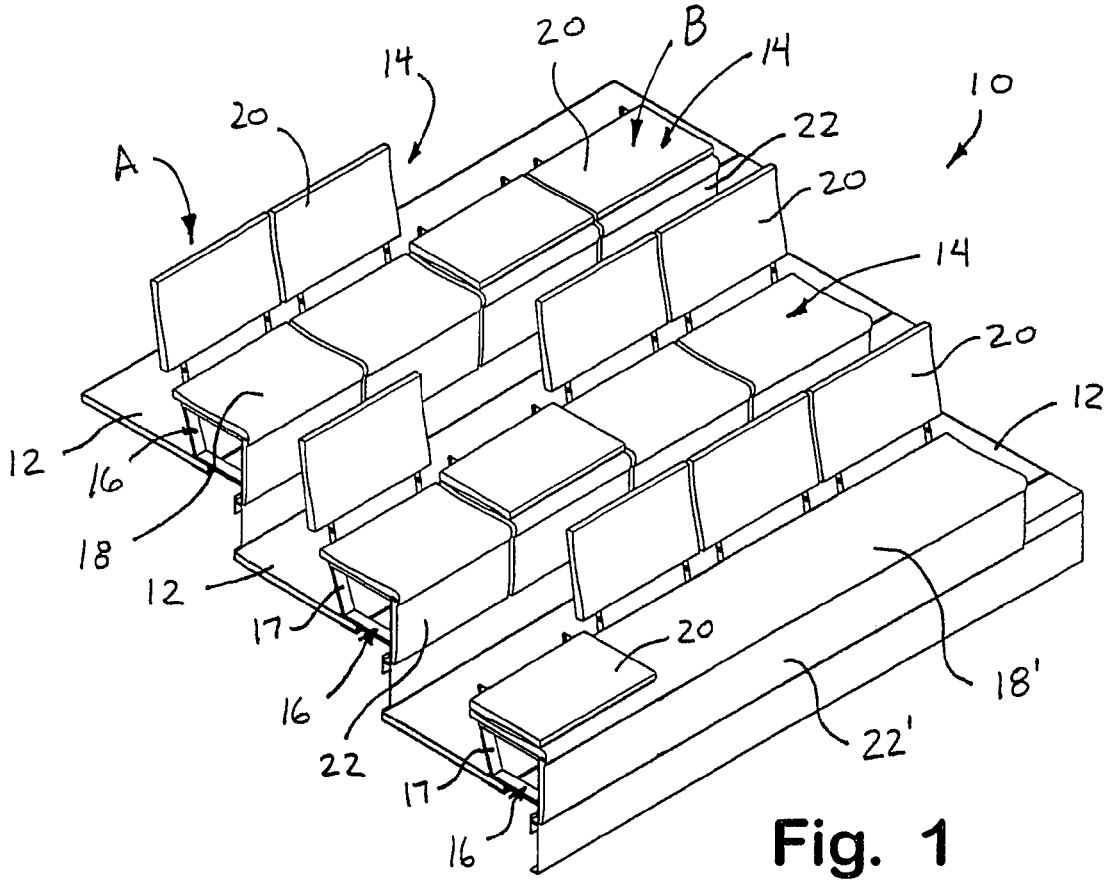
FIG. 1 is a perspective view of a bleacher seating arrangement incorporating a plurality of foldable seat backs in accordance with the present invention.

Referring now to the drawings and the illustrative embodiments depicted therein, a bleacher seating arrangement 10 includes a plurality of tiers or levels or decks 12, which have a plurality of seats or seat areas 14 positioned therealong (FIG. 1). The seats 14 include a mounting frame or support frame 16 that is fixedly secured, such as via bolts or fasteners or the like, to an upper and forward end portion of the respective deck 12. Seats 14 further include a seat portion 18 fixedly secured to mounting frame 16 and a seat back or back portion 20 that is pivotally or hingedly mounted to or attached to mounting frame 16, such that seat back 20 may be pivotal between an upright position (shown generally at A in FIG. 1) and a lowered or folded down position (shown generally at B in FIG. 1). Seats 14 may also include a front cover portion or panel 22 attached to mounting frame 16, such that seat portion 18 and cover portion 22 function to substantially cover and conceal mounting frame 16 to provide a finished appearance to the seats of the present invention. The seats 14 thus provide a more comfortable seating arrangement for bleachers and the like, with each seat or seat area having a respective seat back that may be individually folded down onto the seat portion when not in use. The foldable seats of the present invention thus may be particularly suitable for extendable and retractable bleacher seating arrangements, where the lower decks or benches may be retracted to be positioned generally beneath the upper deck or bench when the seat back is in its folded down position.

Figure 2:
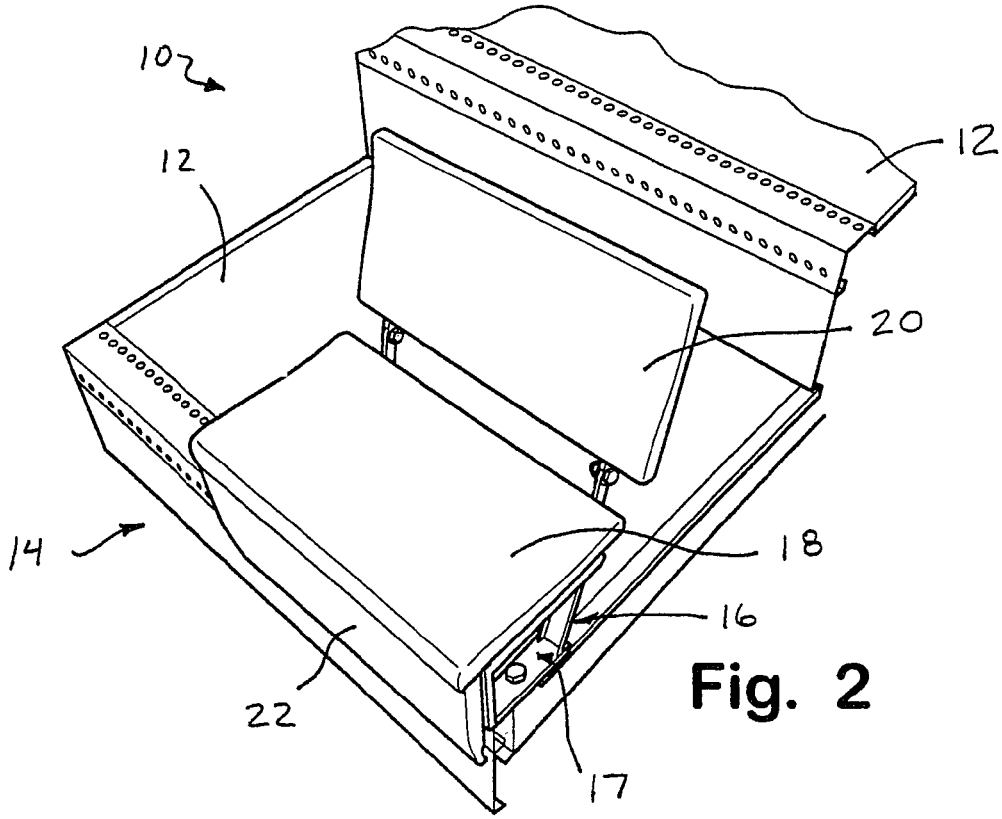
FIG. 2 is a perspective view of one of the seats of FIG. 1.
Figure 3:
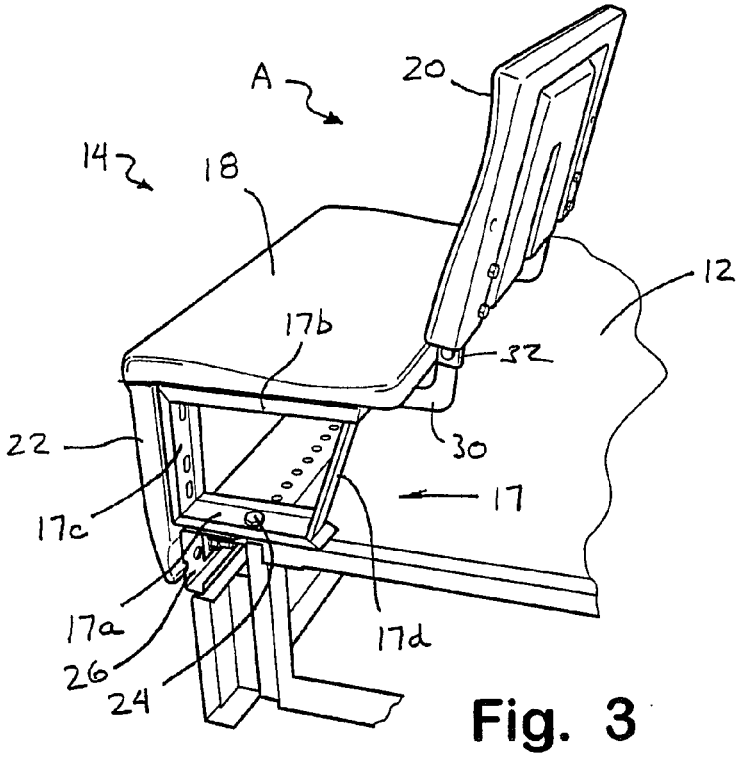
FIG. 3 is a rear perspective view of the seat of FIG. 2.
Figure 4:
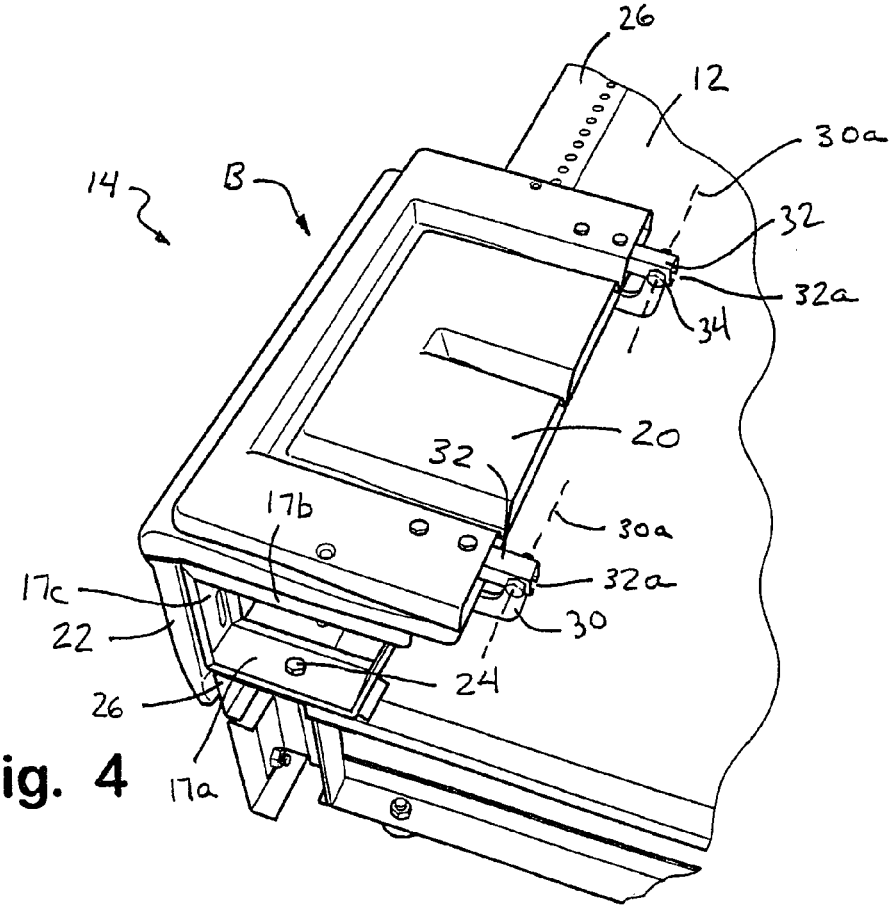
FIG. 4 is another rearward perspective view of the seat of FIGS. 2 and 3, showing the seat back in its folded down position.
Figure 7:
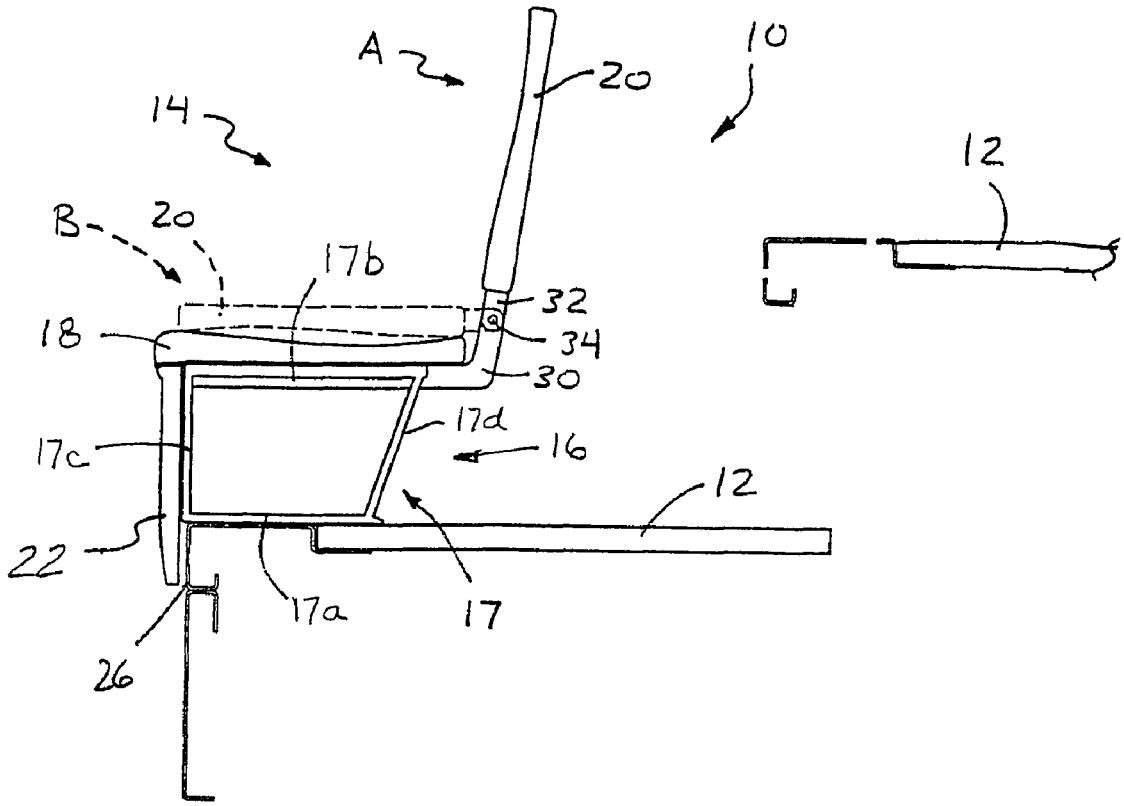
FIG. 7 is a side elevation of the seat of FIG. 6.

Seats 14 are fixedly secured to the respective deck 12 via mounting frame 16, which may comprise a plurality of frame portions 17 spaced apart along and secured to deck 12 of bleachers 10. Each frame portion 17 may comprise one or more metallic bracket members or the like connected together or joined to form a frame or support portion for an end or portion of each seat. For example, and as shown in FIGS. 3, 4 and 7, each frame portion 17 may include a lower or base frame member 17*a* and an upper seat supporting member 17*b* that is spaced from and secured to base frame member 17*a* via a pair of upwardly extending frame members or bracket members 17*c*, 17*d*. Lower frame member 17*a* of frame portions 17 may be bolted to or otherwise secured to or fastened to the deck or bench 12 of the bleacher seating arrangement. For example, as can be seen in FIGS. 2-4, a bolt or fastener 24 may extend through lower frame member 17*a* of frame portion 17 and into a corresponding bracket or bracing member 26 positioned along the forward and upper edge of the deck or bench 12.

Each seat portion 18 may be mounted or secured at its opposite ends to the upper member 17*b* of a respective frame portion 17, such that seat portion 18 is spaced from or raised above deck portion 12 of bleacher seating arrangement 10. Likewise, each of the front cover panels 22 may also be mounted at its opposite ends to the forward upwardly extending members 17*c* of the respective frame portions 17. Seat portion 18 may comprise a durable, hard and substantially rigid plastic material and may be bolted to or otherwise secured to upper frame members 17*b*. Plastic seat portion 18 may be curved or contoured to provide a comfortable seat for a person to sit on when the seat back 20 is raised to its upright position. Likewise, front cover panel 22 may comprise a hard, durable and substantially rigid plastic material that may be bolted or fastened or otherwise secured to the front frame members 17*c*. As can be seen in FIGS. 3, 4 and 7, the forward edge of seat portion 18 may overlap and generally engage or abut against an upper edge of front cover 22, such that the front cover 22 and seat portion 18 combine or cooperate to substantially cover and conceal or hide mounting frame 16 to provide a finished appearance to the foldable seat of the present invention. As shown in FIG. 1, multiple seat portions 18 and front cover panels 22 may be mounted to their respective pairs of frames or frame portions 17 and may be positioned adjacent to one another along the deck 12 of the bleacher seating arrangement 10. Optionally, and as also shown in the lower or forward deck portion in FIG. 1, a single seat portion or bench 18' (that provides a seating area for a plurality of people) may be mounted to and along a plurality of frame portions 17, while a single elongated front cover panel 22' may also be mounted to the plurality of frame portions, such that the elongated seat portion 18' and the elongated cover portion 22' define a finished raised plastic bench along and spaced above from the deck or bench.

In the illustrated embodiments, each seat back or back portion 20 is pivotally attached to mounting frame 16 and/or seat portion 18 and is generally freely pivotable between the upright and folded down positions. The back portion 20 thus may be readily raised to the upright position to allow a person to sit down at the seat portion, or may be readily pushed downward or collapsed to its folded down position to cover the seat portion and/or to allow the bleacher decks to be retracted to a storage position. Similar to seat portion 18, back portion 20 may comprise a hard, durable and substantially rigid plastic material and may also be contoured or formed or shaped to conform to the general curvature or a person's back to provide a comfortable backrest for a person sitting at the foldable seat of the present invention. Each back portion 20 may be pivotally mounted at a respective one of the plurality of seat portions 18, or a plurality of back portions 20 may be pivotally mounted along the elongated seat portion or bench 18', without affecting the scope of the present invention. In either embodiment, the back portions may be independently pivotable between the upright and folded down positions.

In the illustrated embodiments, mounting frame 16 includes a hinge member 30 (FIGS. 3, 4, 6 and 7) that extends at least partially along each of the upper frame members 17*b* and that extends generally rearwardly from seat portion 18 for pivotally attaching or mounting seat back or back portion 20 thereto. As shown in FIGS. 3, 4 and 7, hinge member 30 may curve upwardly at a rearward end thereof and may provide or define a pivot axis or a pivot point 30*a* at a position generally above the upper surface of seat portion 18. Back portion 20 may include a pair of hinge members 32 which extend downwardly from back portion 20 and which are pivotally attached to hinge members 30, such as via pivot pins 34 or the like. In the illustrated embodiment, hinge member 32 may comprise a tubular member with a slot 32*a* (FIG. 4), and may receive the upper end of hinge member 30 therein. The slot 32*a* of hinge member 32 allows for pivotal movement of hinge member 32 relative to hinge member 30 to allow the seat back to be folded to its lowered or folded down or collapsed orientation, while the unslotted portion of the hinge member 32 at the upper end of the slot 32*a* provides a stop to limit or substantially preclude pivotal movement of back portion 20 beyond its desired upright position.

Figure 5:
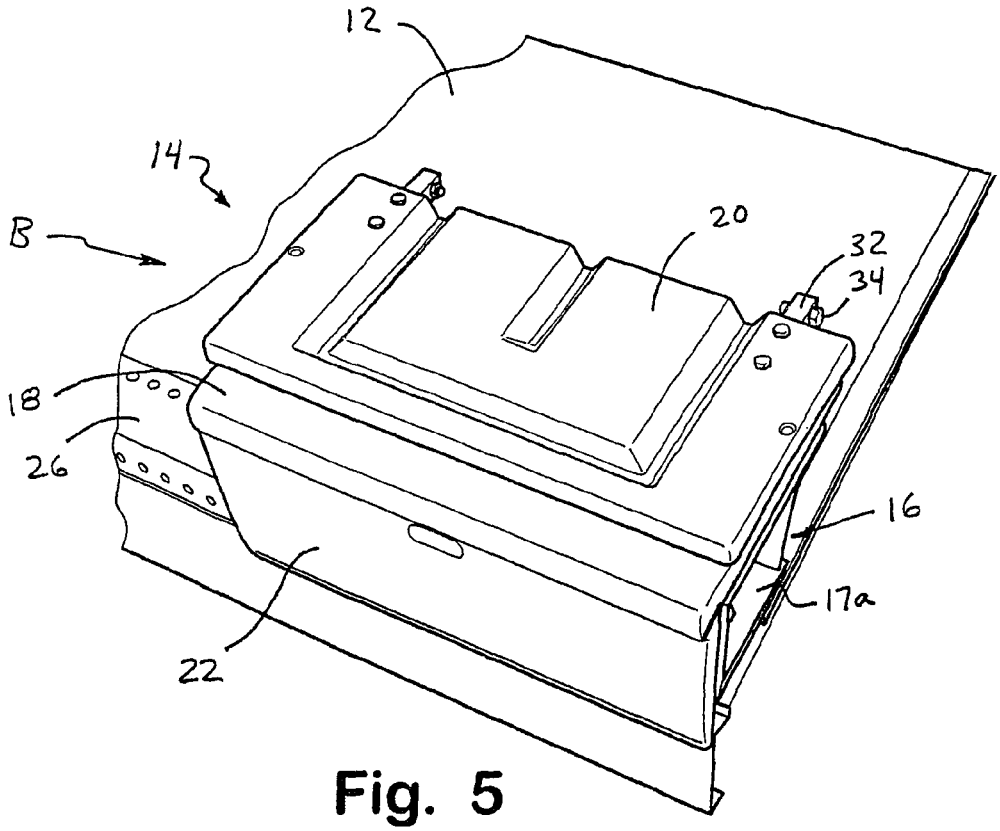
FIG. 5 is a forward perspective view of seat of FIG. 4.
Figure 6:
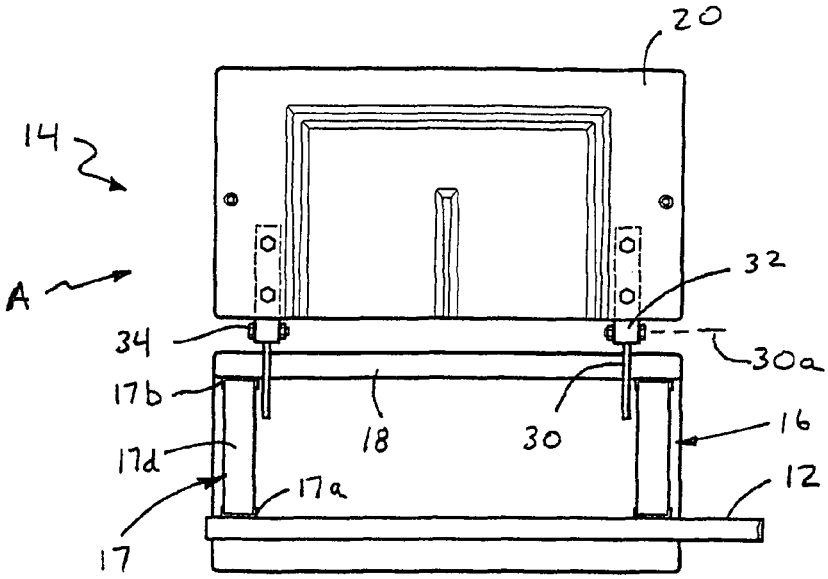
FIG. 6 is a rear elevation of the seat of FIGS. 2-5, showing the seat back in its upright position.

Back portion 20 is thus pivotally mounted to mounting frame 16 and/or seat portion 18 and is pivotable about pivot axis 30*a*, such that back portion 20 may pivot downward to its folded down position and may lay generally on top of seat portion 18, as can be seen in FIGS. 4, 5, and 7. When it is not desired to be used, the seat backs may be readily pivoted to their folded down orientation to lay generally on top of and overlapping the seat portion. As can be seen in FIG. 7, when back portion 20 is folded or pivoted to its folded down orientation, the back portion is positioned generally beneath a level of the next rearward and upper deck portion or bench 12, such that the deck portions may be retracted to a retracted or nested position relative to one another.

Accordingly, the foldable seat of the present invention may be fixedly secured to a deck or platform of a bleacher type seating arrangement and may provide a seat portion that is elevated above the deck portion for a person to sit thereon for viewing an event. The seat back or back portion may be readily raised to its upright position to allow a person to sit on the seat portion associated with the respective back portion. A person thus may manually lift or pivot the back portion upward and may then sit at the seat portion, while the back portion provides back support for the person sitting in the seat portion. The back portion may be readily lowered or pivoted to a folded down position to allow the bleachers to be retracted into a nested arrangement. The back portion may pivot down to lay generally on top of the seat portion to limit the additional height or clearance required above the seat portion to allow the tiers or decks of the bleachers to be retracted.

Changes and modifications to the specifically described embodiments may be carried out without departing from the principles of the present invention, which is intended to be limited only by the scope of the appended claims as interpreted according to the principles of patent law.

The embodiments of the invention in which an exclusive property or privilege is claimed are defined as follows:

1. A bleacher seating arrangement comprising:

an elongated seat structure, said elongated seat structure being fixedly secured relative to a deck portion of a bleacher, said elongated seat structure comprising a substantially continuous bench structure providing a plurality of seating areas therealong;

at least one mounting frame, said at least one mounting frame being fixedly attached to the deck portion of the bleacher;

a plurality of back portions, said back portions being pivotally mounted to said at least one mounting frame and pivotable between an upright position and a folded down position, said back portions being disposed along said elongated seat structure at respective ones of said plurality of seating areas along said elongated seat structure, said back portions and said elongated seat structure providing said seating areas for a user when the respective back portion is in said upright position, said back portion being positioned at least partially over a respective portion of said elongated seat structure when said back portion is in said folded down position; and a front panel fixedly disposed at a forward portion of said elongated seat structure that is fixed relative to said deck portion of said bleacher, wherein said front panel extends generally vertically downward along said elongated seat structure and at said forward portion of said elongated seat structure opposite said plurality of back portions, said front panel at least partially closing over an area below said forward portion of said elongated seat structure.

2. The bleacher seating arrangement of claim 1, wherein each of said back portions is pivotally mounted to said at least one mounting frame via at least one pivot pin.

3. The bleacher seating arrangement of claim 1, wherein at least one of said back portion and said at least one mounting frame comprises a stop element to limit pivotal movement of said back portion relative to said at least one mounting frame at said upright position.

4. The bleacher seating arrangement of claim 1, wherein each of said back portions is pivotally mounted to said at least one mounting frame via a first hinge member extending from said back portion and pivotally attaching to a second hinge member of said mounting frame.

5. The bleacher seating arrangement of claim 1, wherein each of said back portions is substantially freely pivotable between said upright position and said folded down position.

6. The bleacher seating arrangement of claim 1, wherein said elongated seat structure is contoured to define a plurality of seating surfaces for a plurality of persons to sit on, each of said back portions being disposed at a respective one of said plurality of seating surfaces, wherein each of said back portions is contoured.

7. The bleacher seating arrangement of claim 1, wherein said elongated seat structure is fixedly secured to said mounting frame.

8. A bleacher seating arrangement for seating a plurality of people along at least one row of seats, said bleacher seating arrangement comprising:

at least one deck portion, said at least one deck portion being generally horizontally oriented;

at least one seat structure fixedly disposed at said at least one deck portion, said at least one seat structure being configured for seating a plurality of persons at said at least one deck portion;

at least one mounting frame fixedly secured to each of said deck portions;

a plurality of back portions pivotally mounted to said at least one mounting frame, said plurality of back portions being disposed along a rearward portion of said at least one seat structure, said plurality of back portions being individually pivotable between an upright position, where a person may sit at said at least one seat structure at the respective back portion, and a folded down position, where said back portion is pivoted down at least partially over a respective portion of said at least one seat structure at which said back portion is positioned; and at least one front panel fixedly disposed at a forward portion of said elongated seat structure that is fixed relative to said at least one deck portion, wherein said front panel extends generally vertically downward along said at least one seat structure and at said forward portion of said at least one seat structure opposite said plurality of back portions, said front panel at least partially closing over an area below said forward portion of said at least one seat structure.

9. The bleacher seating arrangement of claim 8, wherein said at least one elongated seat structure comprises a substantially continuous elongated bench that defines a plurality of individual seating areas, said back portions being disposed generally at respective ones of said individual seating areas.

10. The bleacher seating arrangement of claim 8, wherein said at least one seat structure comprises at least two seat portions fixedly secured relative to said deck portion and arranged along said deck portion.

11. The bleacher seating arrangement of claim 8, wherein said at least one deck portion comprises a plurality of deck portions, each of said deck portions having at least one respective seat structure and respective back portions, and wherein said deck portions are movable relative to one another between a nested position, where said deck portions are arranged generally on top of one another, and an extended position, where a lower deck portion is extended outward from an upper deck portion so that the deck portions are arranged in a stepped manner.

12. The bleacher seating arrangement of claim 8, wherein each of said back portions is pivotable about said generally horizontal pivot axis via at least one pivot pin.

13. The bleacher seating arrangement of claim 8, wherein at least one of said back portion and said at least one mounting frame comprises a stop element to limit pivotal movement of said back portion relative to said at least one mounting frame at said upright position.

14. The bleacher seating arrangement of claim 8, wherein said at least one mounting frame extends upwardly from said deck portion generally at said rearward portion of said at least one seat structure, and wherein said back portion is pivotally mounted to an upper portion of said at least one mounting frame.

15. A bleacher seating arrangement for seating a plurality of people along at least one row of seats, said bleacher seating arrangement comprising:

a plurality of deck portions, each of said deck portions being generally horizontally oriented, said deck portions being movable relative to one another between a nested position, where said deck portions are arranged generally on top of one another, and an extended position, where a lower deck portion is extended outward from an upper deck portion so that the deck portions are arranged in a stepped manner;

an elongated seat structure fixedly disposed at each of said deck portions, said elongated seat structure being fixedly secured relative to said deck portion, said elongated seat structure being configured for seating a plurality of people at the respective deck portion, said elongated seat structure having a forward portion and a rearward portion extending along said elongated seat structure;

at least one mounting element fixedly secured to each of said deck portions and disposed at least partially at said rearward portion of said elongated seat structure;

a plurality of back portions pivotally mounted at said at least one mounting element at said rearward portion of said elongated seat structure and pivotable about a generally horizontal pivot axis, said plurality of back portions being individually pivotable between an upright position, where a person may sit at said elongated seat structure at the respective back portion, and a folded down position, where said back portion is pivoted down at least partially over a respective portion of said elongated seat structure at which said back portion is positioned, said back portions being pivoted to said folded down position when said deck portions are in said nested position; and at least one front panel fixedly disposed at said forward portion of said elongated seat structure that is fixed relative to said deck portion, wherein said front panel extends generally vertically downward along said elongated seat structure and at said forward portion of said elongated seat structure opposite said plurality of back portions, said front panel at least partially closing over an area below said forward portion of said elongated seat structure.

16. The bleacher seating arrangement of claim 15, wherein each of said back portions is pivotally mounted to said at least one mounting element via at least one pivot pin.

17. The bleacher seating arrangement of claim 15, wherein at least one of said back portions and said at least one mounting element comprises a stop element to limit pivotal movement of said back portion relative to said at least one mounting element at said upright position.

18. The bleacher seating arrangement of claim 15, wherein each of said back portions is pivotally mounted to said at least one mounting element via a first hinge member extending downward from said back portion and pivotally attaching to a second hinge member of said at least one mounting element.

19. The bleacher seating arrangement of claim 18, wherein at least one of said first hinge member and said second hinge member comprises a stop element to limit pivotal movement of said back portion relative to said at least one mounting element at said upright position.

20. The bleacher seating arrangement of claim 15, wherein said elongated seat structure comprises a substantially continuous elongated bench that defines a plurality of individual seating areas, said back portions being disposed generally at respective ones of said individual seating areas.

21. A seating assembly comprising, in combination:

a plurality of deck portions movably mounted relative to each other between a first position wherein said deck portions are stacked vertically one above the other and a second position wherein each of said deck portions protrude outwardly in tiered fashion forming a bleacher seating support structure;

a plurality of seat backs and seat bases, wherein said seat backs are pivotably mounted with respect to said seat bases between a full up position allowing a person to use the seat, and a down position in which said seat backs nest over the top of said seat bases allowing storage of said seating assembly when said deck portions are positioned in said first position;

said seat bases comprised of a seat structure fixedly secured relative to said deck portion, said seat structure providing a plurality of seating areas along each deck portion with each of said seating areas having a respective one of said seat backs disposed thereat; and a stop element to limit pivotal movement of said seat back relative to said seat base when said seat back is pivoted to said full up position.

22. The seating assembly of claim 21, wherein said seat backs overlap said seat bases in a relatively flush nature when positioned in said second position.

23. A seating assembly comprising, in combination:

a plurality of deck portions movably mounted relative to each other between a first position wherein said deck portions are stacked vertically one above the other, and a second position wherein each of said deck portions protrude outwardly in tiered fashion forming a bleacher seating support structure;

a plurality of seat backs and seat bases, wherein said seat backs are pivotably mounted with respect to said seat bases between a full up position allowing a person to use the seat, and a down position in which said scat backs nest over the top of said seat bases allowing storage of said seating, assembly when said deck portions are positioned in said first position;

said seat bases comprised of a seat structure fixedly secured relative to said deck portion, said seat structure providing a plurality of seating areas along each deck portion with each of said seating areas having a respective one of said seat backs disposed thereat; and at least one front panel fixedly disposed at a forward portion of said seat structure that is fixed relative to said deck portion, wherein said front panel extends generally vertically downward along said seat structure and at said forward portion of said seat structure opposite said plurality of seat backs, said front panel at least partially closing over an area below said forward portion of said seat structure.

24. A bleacher seating arrangement comprising:

a deck portion of a bleacher;

a plurality of seat backs and seat bases, wherein said seat backs are pivotably mounted with respect to said seat bases between a full up position allowing a person to use the seat, and a down position in which said seat back nests over the top of said seat base allowing storage of said seating assembly when said deck portion is positioned in a nested position;

said seat bases comprised of a seat structure fixedly secured relative to said deck portion, said seat structure providing a plurality of seating areas along each deck portion with each of said seating areas having a respective one of said seat backs mounted thereat; and at least one front panel fixedly disposed at a forward portion of said seat structure that is fixed relative to said deck portion of said bleacher, wherein said front panel extends generally vertically downward along said seat structure and at said forward portion of said seat structure opposite said plurality of seat backs, said front panel at least partially closing over an area below said forward portion of said seat structure.

25. The bleacher seating arrangement of claim 24, wherein said seat back overlaps said seat base in a relatively flush nature when positioned in said down position.

26. The bleacher seating arrangement of claim 24 further comprising a stop element to limit pivotal movement of said seat back relative to said seat base when said seat back is pivoted to said full up position.

* * * * *

UNITED STATES PATENT AND TRADEMARK OFFICE

CERTIFICATE OF CORRECTION

PATENT NO. : 7,905,546 B2
APPLICATION NO. : 11/851885
DATED : March 15, 2011
INVENTOR(S) : Larry R. Conner It is certified that error appears in the above-identified patent and that said Letters Patent is hereby corrected as shown below:

Column 9
Line 27, Claim 23, "scat" should be --seat--
Line 29, Claim 23, Delete "," after "seating"

Signed and Sealed this
Thirteenth Day of March, 2012

David J. Kappos

David J. Kappos
*Director of the United States Patent and Trademark Office*